US008096082B2

(12) United States Patent
Moran

(10) Patent No.: US 8,096,082 B2
(45) Date of Patent: Jan. 17, 2012

(54) PORTABLE CHANGING ROOM THAT IS INFLATABLE

(76) Inventor: Gabriella Veronica Moran, Miami, FL (US)

( * ) Notice: Subject to any disclaimer, the term of this patent is extended or adjusted under 35 U.S.C. 154(b) by 81 days.

(21) Appl. No.: 12/710,469

(22) Filed: Feb. 23, 2010

(65) Prior Publication Data

US 2011/0203189 A1 Aug. 25, 2011

(51) Int. Cl.
*E04H 1/12* (2006.01)
*E04H 15/20* (2006.01)

(52) U.S. Cl. ..... 52/2.18; 52/2.25; 135/902; 446/220

(58) Field of Classification Search ..... 52/2.17, 52/2.18, 2.25; 446/220; 135/902
See application file for complete search history.

(56) References Cited

U.S. PATENT DOCUMENTS 1,964,818 A * 7/1934 Hood ..... 52/2.21
2,875,771 A * 3/1959 Brewin ..... 52/2.11
3,540,170 A * 11/1970 Flowers ..... 52/2.19
3,840,919 A * 10/1974 Middleton ..... 5/413 AM
3,868,295 A * 2/1975 Boone, Jr. ..... 428/10
3,994,102 A * 11/1976 Johnson et al. ..... 52/2.21
4,171,595 A * 10/1979 Tucker ..... 52/2.21
4,332,112 A * 6/1982 Hsu ..... 52/2.21
4,556,391 A * 12/1985 Tardivel et al. ..... 446/7
5,301,706 A 4/1994 Jones
5,430,980 A 7/1995 Ferrier
5,570,544 A * 11/1996 Hale et al. ..... 52/2.18
5,592,961 A 1/1997 Chin
5,761,852 A * 6/1998 Liu ..... 52/2.18
5,893,238 A * 4/1999 Peacock et al. ..... 52/2.18
5,987,822 A * 11/1999 McNiff et al. ..... 52/2.11
6,702,119 B2 3/2004 Sabounjian
6,840,254 B1 1/2005 Windham
D557,813 S * 12/2007 Charette ..... D24/209
7,464,983 B1 12/2008 Acosta
2006/0283493 A1 * 12/2006 Charles ..... 135/121

FOREIGN PATENT DOCUMENTS

FR 2 590 177 A1 * 5/1987

* cited by examiner

*Primary Examiner* — Robert Canfield

(57) ABSTRACT

A portable changing room that is inflatable. The portable changing room includes an inflatable skeleton, a valve, and a removable cover. A pump is used to inflate the inflatable skeleton. The changing room is used for privacy in outdoor environments.

11 Claims, 2 Drawing Sheets

PORTABLE CHANGING ROOM THAT IS INFLATABLE

BACKGROUND

Figure 1:
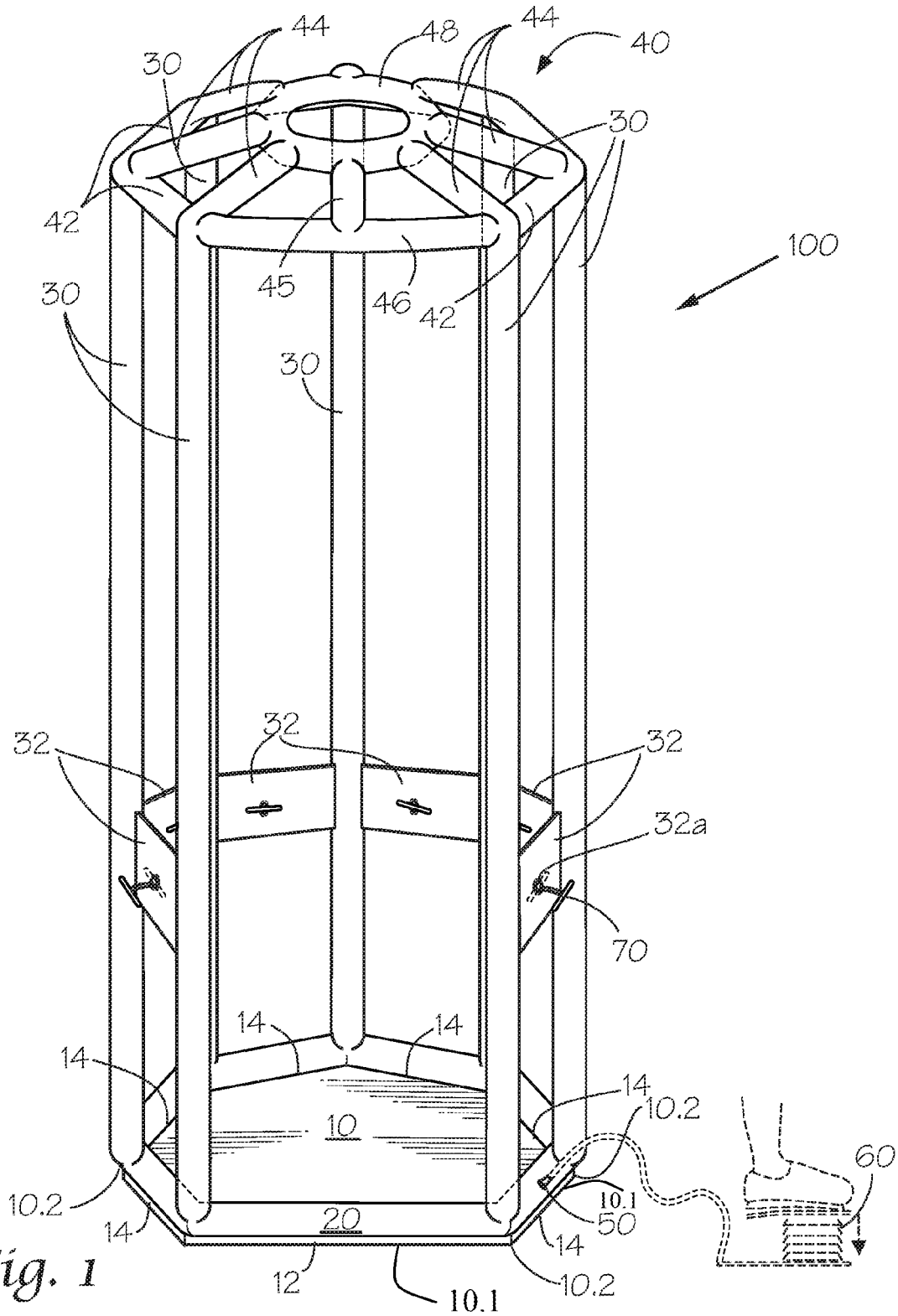

The present invention is directed to portable changing rooms that can be used in remote locations.

The inventor of the present invention conceived the present invention because of her need for privacy as a youngster. She played high school soccer and realized that during many weekend tournaments she would find herself on fields that where quite a distance away from changing rooms, and that when she had uniform malfunctions, it became very awkward to fix the uniform or to change her uniform.

When watching professional sports, she also noticed that professional players, during the heat of games were sometimes forced to have uniform malfunctions fixed before full stadiums. Usually, they accomplished this by having teammates surround the player while an equipment manager fixed the uniform malfunction or the player changed his/her uniform.

She also found herself having the same issue of needing a changing room when she went to the beach. On more than one occasion, she was forced to go home in a wet bathing suit because of the lack of changing rooms.

Portable changing rooms have been described in the prior art, yet they have not shown themselves to be practical or affordable. Some prior art changing rooms proved themselves difficult to assemble or were too expensive to be marketable. U.S. Pat. No. 5,592,961 describes a portable changing room that unwinds into a changing room. The patent appears to unfold quite nicely into a changing room, yet it appears that it would take some effort to house the changing room after use. Other patents describe portable changing rooms, yet they appear to have parts that could easily be lost after a few uses.

The inventor does not know of any prior art that discloses a portable changing room that has an inflatable skeleton that has a removable cover that is slid over the inflatable skeleton after inflation.

Accordingly, there is a need for an inexpensive, durable, light weight, and easily transportable portable changing room that is inflatable which can be assembled and disassembled in a timely manner.

SUMMARY

The present invention is directed to an portable changing room that is inflatable that is inexpensive, durable, light weight, and easily transportable. The present invention comprises of an inflatable skeleton, a cover that slides over the inflatable skeleton after the inflatable skeleton is filled with air, and a valve that is attached to the inflatable skeleton. A pump is used to fill the inflatable skeleton.

The inflatable skeleton comprises of a seven sided flexible weighted mat base, wherein one side of the flexible mat base is approximately two times the size of the remaining sides of the flexible mat base, a base inflatable air channel connected to the flexible mat base around the mat base's periphery and, seven vertical air channels connected to the base inflatable air channel at positions that line up with each corner of the flexible mat base, each vertical air channel measures at least six feet in height and each vertical channel has a diameter of at least three inches, six webbing panels fixedly attached between all of the vertical air channels having the same separating distance between them and at a position of at least one third of the height of the vertical air channels from the flexible mat base, and an inflatable domed ceiling attached to the seven vertical air channels. The dome comprising of a first dome air channel that has the same dimensions as the base inflatable air channel and that aligns with the base inflatable air channel, seven dome air channels connectors connected to the first dome air channel so that each of the seven dome air channel connectors flow from positions aligned from each of the vertical air channels, a shorter dome air channel connector that is attached to the first dome air channel at a position between the largest side of the first dome air channel, and lastly a second circular dome air channel that attaches to all of the air channel connectors, all of the inflatable skeleton air channels are connected so that air can flow undisrupted through them. Lastly, a valve, the valve attaches to one of the inflatable skeleton's air channels near the flexible mat base.

The inflatable skeleton might be inflated with a portable foot air pump or with a powered air pump.

The cover is a heptagonal enclosure that has dimensions that allow it to be slid over the inflatable skeleton from the dome section of the inflatable skeleton toward the base, the cover is be made to have a slightly larger diameter than the inflatable skeleton, thereby allowing the cover to be easily slid over the inflatable skeleton. The cover would have a foldable opening on the side of the cover that fits over the largest side of the mat base. The foldable opening might be secured by a zipper, hook and loop materials, or magnets. The cover might be made of nylon or of any other materials known in the art to promote privacy and that is light weight and durable.

The portable inflatable changing room of the present invention is used by first placing the flexible mat on a surface, then finding the valve of the portable inflatable changing room, then attaching an air pump to the valve, then inflating the inflatable skeleton of the portable changing room so that the inflatable skeleton is rigid, next sliding that cover over the inflatable skeleton, and lastly, securing the portable changing room to the surface.

An object of the present invention is to allow a user to have an inflatable portable changing room that can be easily assembled and disassembled in most locations.

DRAWINGS

Figure 2:
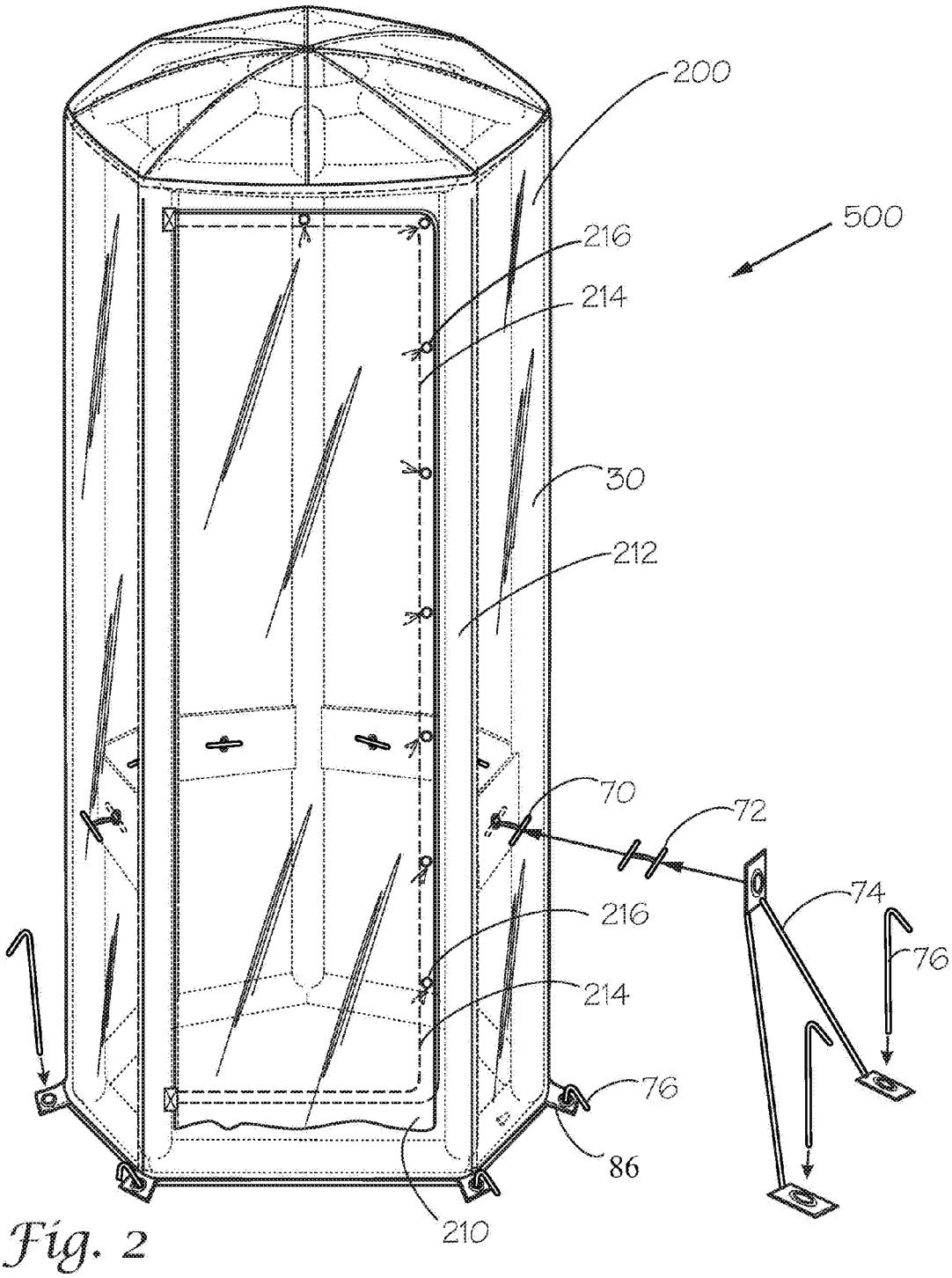

These and other features, aspects, and advantages of the present invention will become better understood with regard to the following description, appended claims, and drawings where:

FIG. 1 is a perspective view of the inflatable skeleton of the present invention; and FIG. 2 is a perspective of the present invention, wherein a cover is over the inflatable skeleton.

DESCRIPTION

The following discussion describes in detail one embodiment of the invention and several variations of that embodiment. This discussion should not be construed as limiting the invention to that particular embodiment or to those particular variations. Practitioners skilled in the art will recognize numerous other embodiments and variations, as well. For a definition of a complete scope of the invention, the reader is directed to the appended claims.

An portable changing room that is inflatable 500 according to the present invention comprises an inflatable skeleton 100, a valve 50, and a removable cover 200.

The inflatable skeleton 100 comprises of a seven sided flexible weighted mat base 10, wherein one side 12 of the flexible weighted mat base 10 is approximately two times the size of the remaining sides 14 of the flexible mat base 10, a base inflatable air channel 20 connected to the flexible weighted mat base 10 around the flexible weighted mat base's periphery 10.1 and, seven vertical air channels 30 connected to the base inflatable air channel 20 at positions that line up with each corner 10.2 of the flexible weighted mat base 10, each vertical air channel 30 measures at least six feet in height and each vertical air channel 30 has a diameter of at least three inches, six webbing panels 32 fixedly attached between all of the vertical air channels 30 and having the same separating distance between each vertical air channel 30 and at a position that is at least one third of the height of each vertical air channel 30 from the flexible weighted mat base 10, and an inflatable domed ceiling 40 attached to the seven vertical air channels 30. The dome ceiling 40 comprising of a first dome air channel 42 that has the same dimensions as the base inflatable air channel 20 and that aligns with the base inflatable air channel 20, seven dome air channels connectors 44 connected to the first dome air channel 42 so that each of the seven dome air channel connectors 44 flow from positions aligned from each of the vertical air channels 30, a shorter dome air channel connector 45 that is attached to the first dome air channel 42 at a position between the largest side 46 of the first dome air channel 42, and lastly a second circular dome air channel 48 that attaches to all of the air channel connectors 44/45, all of the inflatable skeleton air channels 20/30/42/44/45/48 are connected so that air can flow undisrupted through them. Lastly, a valve 50, the valve attaches to one of the inflatable skeleton's air channels 20/30 near the flexible mat base 10.

The inflatable skeleton might be inflated with a portable foot air pump 60 or with a powered air pump 60.

The removable cover 200 is a heptagonal enclosure 200 that has dimensions that allow it to be slid over the inflatable skeleton 100 from the dome section 40 of the inflatable skeleton 100 toward the flexible weighted mat base 10, the cover 200 is made to have a slightly larger diameter than the inflatable skeleton 100, thereby allowing the cover 200 to be easily slid over the inflatable skeleton 100. The cover 200 has a foldable opening 210 on the side of the cover 212 that fits over the largest side 12 of the flexible weighted mat base 10. The foldable opening might be secured by a zipper 214, or magnets 216. The cover 200 might be made of nylon or of any other materials known in the art to promote privacy and that is light weight and durable. The cover 200 might further comprise of a first set of grommets 86 attached to each corner of the heptagonal enclosure 200 at a location of the heptagonal enclosure 200 that would rest over the mat base 10. Each grommet 86 is secured to a surface by a pin 76.

In a further embodiment of the present invention, the webbing panels 32 would define an aperture 32*a* centrally located within each webbing panel 32. The embodiment would further comprise of an I hook 70, the I hook 70 having two ends, the first end of the I hook 70 inserts within the aperture 32*a*, a second set of grommet attachments 74, each grommet attachment 74 having one top grommet attachment, two securing means flowing from each grommet attachment and a ground grommet attachment attached to each securing means, each grommet attachment 74 attaches to the second end of each I hook 72 and a pin 76 secures each ground grommet attachment to the surface.

The portable changing room that is inflatable 500 of the present invention is used by first placing the flexible weighted mat base 10 on a surface, then finding the valve 50 of the inflatable skeleton 100, then attaching an air pump 60 to the valve 50, then inflating the inflatable skeleton 100 of the portable changing room so that the inflatable skeleton 100 is rigid, next sliding the cover 200 over the inflatable skeleton 100, and lastly, securing the portable changing room 500 to the surface.

An advantage of the present invention is that it allows a user to use a portable changing room that is inflatable which is easily assembled and disassembled.

Although the present invention has been described in considerable detail in reference to preferred versions, other versions are possible. Therefore, the spirit and scope of the appended claims should not be limited to the description of the preferred versions contained herein.

What is claimed is:

1. A portable changing room that is inflatable, comprises:

An inflatable skeleton, comprises of, a seven sided flexible weighted mat base, wherein one side of the flexible weighted mat base is approximately two times the size of the remaining sides of the flexible mat base, a base inflatable air channel connected to the flexible weighted mat base around the flexible weighted mat base's periphery, seven vertical air channels connected to the base inflatable air channel at positions that line up with each corner of the flexible weighted mat base, each vertical air channel measures at least six feet in height and each vertical air channel 30 has a diameter of at least three inches, six webbing panels fixedly attached between all of the vertical air channels and having the same separating distance between each vertical air channel and at a position that is at least one third of the height of each vertical air channel from the flexible weighted mat base, and an inflatable domed ceiling attached to the seven vertical air channels, the dome ceiling comprises of, a first dome air channel that has the same dimensions as the base inflatable air channel and that aligns with the base inflatable air channel, seven dome air channels connectors connected to the first dome air channel so that each of the seven dome air channel connectors flows from positions aligned from each of the vertical air channels, a shorter dome air channel connector that is attached to the first dome air channel at a position between the largest side of the first dome air channel, and lastly, a second circular dome air channel that attaches to all of the air channel connectors, all of the inflatable skeleton air channels are connected so that air can flow undisrupted through them;

a valve, the valve attaches to one of the inflatable skeleton's air channels near the flexible mat base; and a removable cover, wherein the cover is an heptagonal enclosure that has dimensions that allow it to be slid over the inflatable skeleton from the dome section of the inflatable skeleton toward the flexible weighted mat base, the cover has a slightly larger diameter than the inflatable skeleton, thereby allowing the cover to be easily slid over the inflatable skeleton, the cover has a foldable opening on the side of the cover that fits over the largest side of the flexible weighted mat base, and the foldable opening is secured by means used to secure two pieces of material together.

2. The portable changing room that is inflatable of claim 1, further comprising a first set of grommets attached to each corner of the heptagonal enclosure at locations of the heptagonal enclosure that rest over the mat base, each first grommet is secured to a surface by a pin.

3. The portable changing room that is inflatable of claim 2, wherein the webbing panels define an aperture centrally located within each webbing panel.

4. The portable changing room of claim 3, further comprising:

an I hook, the I hook has two ends, the first end of the I hook inserts within the aperture; and a second set of grommet attachments, each grommet attachment having one top grommet attachment, two securing means flowing from each grommet attachment and a ground grommet attachment attached to each securing means, each grommet attachment attaches to the second end of each I hook and a pin secures each ground grommet attachment to the surface.

5. The portable changing room that is inflatable of claim 1, wherein the means to secure two pieces of material together is a zipper.

6. The portable changing room that is inflatable of claim 5, wherein the cover is made of nylon.

7. The portable changing room that is inflatable of claim 6, further comprising of either afoot air pump or a powered air pump that attaches to the valve.

8. The portable changing room that is inflatable of claim 1, wherein the means to secure two pieces of material together is magnets.

9. The portable changing room that is inflatable of claim 8, wherein the cover is made of nylon.

10. The portable changing room that is inflatable of claim 7, further comprising of either afoot air pump or a powered air pump that attaches to the valve.

11. A method of using the portable changing room that is inflatable of claim 4, comprising the steps of:

providing the portable changing room that is inflatable;

then, placing the flexible weighted mat base on a surface;

next, finding the valve of the inflatable skeleton;

then, attaching an air pump to the valve;

next, inflating the inflatable skeleton of the portable changing room so that the inflatable skeleton is rigid;

then, sliding the cover over the inflatable skeleton; and lastly, securing the portable changing room to the surface.

* * * * *